US011162766B2

(12) United States Patent
Sillanpaeae et al.

(10) Patent No.: US 11,162,766 B2
(45) Date of Patent: Nov. 2, 2021

(54) SHAPED CHARGE LINER AND METHOD FOR PRODUCTION THEREOF

(71) Applicant: SAAB AB, Linkoeping (SE)

(72) Inventors: Sofia Sillanpaeae, Karlskoga (SE); Thomas Widlund, Karlskoga (SE)

(73) Assignee: SAAB AB, Linkoeping (SE)

( * ) Notice: Subject to any disclaimer, the term of this patent is extended or adjusted under 35 U.S.C. 154(b) by 0 days.

(21) Appl. No.: 16/766,342

(22) PCT Filed: Nov. 23, 2018

(86) PCT No.: PCT/SE2018/051209

§ 371 (c)(1),
(2) Date: May 22, 2020

(87) PCT Pub. No.: WO2019/108115

PCT Pub. Date: Jun. 6, 2019

(65) Prior Publication Data

US 2020/0378730 A1 Dec. 3, 2020

(30) Foreign Application Priority Data

Nov. 29, 2017 (SE) ..... 1700295-7

(51) Int. Cl.
*F42B 1/032* (2006.01)
*F42B 1/036* (2006.01)

(52) U.S. Cl.
CPC ..... *F42B 1/032* (2013.01); *F42B 1/036* (2013.01)

(58) Field of Classification Search
CPC .. F42B 1/02; F42B 1/028; F42B 1/032; F42B 1/036; F42B 3/08; F42B 12/10
USPC ..... 102/306, 307, 476
See application file for complete search history.

(56) References Cited

U.S. PATENT DOCUMENTS

| | | | | |
|---|---|---|---|---|
| 4,498,367 | A | 2/1985 | Skolnick et al. | |
| 4,702,171 | A | 10/1987 | Tal et al. | |
| 4,766,813 | A | 8/1988 | Winter et al. | |
| 6,021,714 | A * | 2/2000 | Grove | E21B 43/117 102/307 |

(Continued)

FOREIGN PATENT DOCUMENTS

FR 2522805 A1 9/1983

OTHER PUBLICATIONS

International Searching Authority, International Search Report and Written Opinion for International Application No. PCT/SE2018/051209, dated Feb. 6, 2019, (12 pages), Swedish Patent and Registration Office, Stockholm, Sweden.

(Continued)

*Primary Examiner* — James S Bergin
(74) *Attorney, Agent, or Firm* — Alston & Bird LLP

(57) ABSTRACT

The present invention relates to a liner for shaped charge for penetrating hard targets, wherein the liner comprises i) a carrier having a density below 9500 kg/m3; and ii) a coating deposited on said carrier comprising at least one metal and/or metal oxide, wherein the coating has a density greater than 10000 kg/m3; wherein the thickness ratio of the carrier to the coating ranges from 100:1 to 1:1, and wherein the oxygen content in the coating is less than 100 ppm atomic. The invention also relates to a method of producing such shaped charge liner and the use 0 thereof in a projectile for penetrating a hard military target.

21 Claims, 1 Drawing Sheet

(56) References Cited

U.S. PATENT DOCUMENTS

| | | | | |
|---|---|---|---|---|
| 6,250,229 | B1 | 6/2001 | Kerdraon et al. | |
| 7,712,416 | B2 * | 5/2010 | Pratt | F42B 1/032 102/307 |
| 7,987,911 | B2 * | 8/2011 | Rhodes | F42B 1/028 166/297 |
| 8,156,871 | B2 * | 4/2012 | Behrmann | F42B 1/028 102/476 |
| 8,443,731 | B1 * | 5/2013 | Stecher | F42B 1/028 102/476 |
| 2003/0037692 | A1 | 2/2003 | Liu | |

OTHER PUBLICATIONS

International Preliminary Examining Authority, International Preliminary Report on Patentability for International Application No. PCT/SE2018/051209, dated Nov. 4, 2019, (9 pages), Swedish Patent and Registration Office, Stockholm, Sweden.

European Patent Office, Extended European Search Report received for Application No. 18883025.1, dated Jul. 22, 2021, 8 pages, Germany.

* cited by examiner

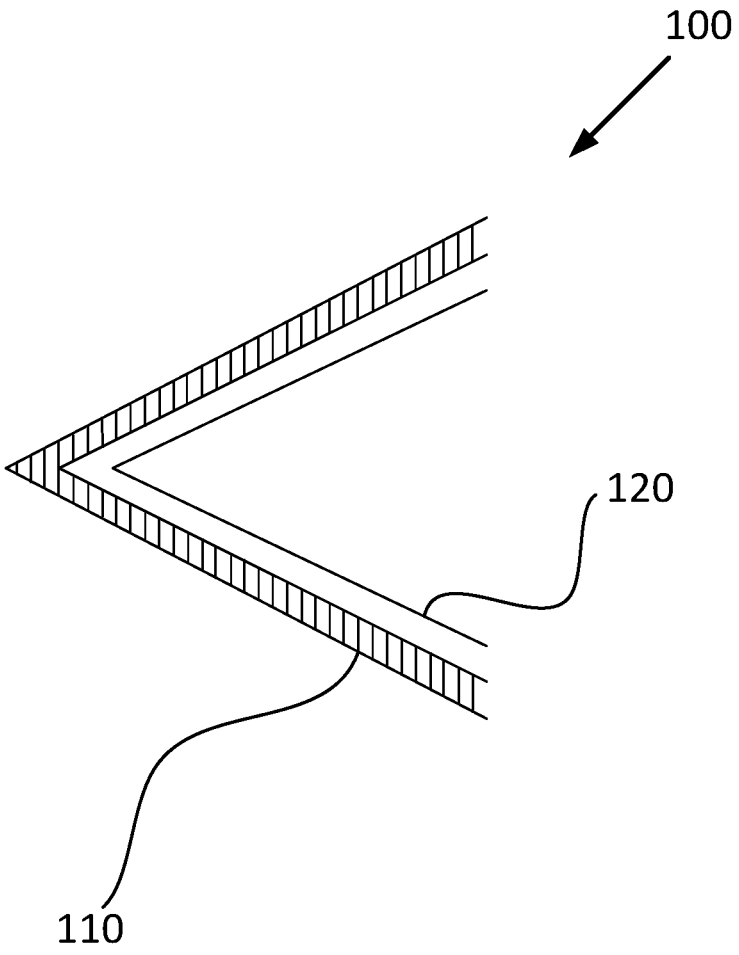
100
120
110

SHAPED CHARGE LINER AND METHOD FOR PRODUCTION THEREOF

CROSS REFERENCE TO RELATED APPLICATIONS

This application is a National Stage Application, filed under 35 U.S.C. § 371, of International Application No. PCT/SE2018/051209, filed Nov. 23, 2018, which claims priority to Swedish Application No. 1700295-7, filed Nov. 29, 2017; the contents of both of which are hereby incorporated by reference in their entirety.

BACKGROUND

Related Field

The invention relates to a shaped charge liner and a method for production thereof. The invention also relates to the use thereof in a projectile for penetration of hard targets such as armour.

Description of Related Art

Shaped charge devices are widely used as means for destroying or penetrating hard targets such as armour or providing perforations in oil wells.

A shaped charge usually comprises a metal casing and an explosive charge within the casing. While the explosive charge can have any desired shape, it generally has a cylindrical shape with one end hollowed out to form a cavity often having a conical shape. The cavity is usually lined with a relatively thin metal liner from which a penetrating jet is formed.

The jet formation process is started by initiating the explosive with a detonator-booster unit. The detonation front travels in an expanding spherical shock wave. As the shock wave passes through the metal liner, the liner collapses. This causes the formation of a penetration jet having a small mass of metal moving at an extremely high velocity and a relatively large mass of metal known as a slug following the jet at a much lower velocity. The tip of the jet has a velocity which is typically about 9.5 km/sec while the tail of the jet has a velocity of about 2 km/sec. The jet's velocity gradient causes it to stretch and ultimately to segment. Although various attempts to improve liners for shaped charges have been made utilizing different types of materials, there are still interests to further improve properties of the liners.

One object of the present invention is to provide a shaped charge liner providing reduced brittleness. A further objective is to provide a liner which does not need admixture of various binders or formation of a matrix. A further objective is thus to provide a liner without a matrix of components reducing the ultimate penetration capacity of the liner. A further objective of the invention is to provide a cost-efficient method of providing a low-density liner with high density of the penetrating portion of the forming jet. A further objective is to provide non-porous liner with limited oxygen content resulting in improved jet properties.

BRIEF DESCRIPTION OF FIGURE

FIG. 1 illustrates a liner for a shaped charge 100, wherein the liner comprises a carrier 110 and a coating 120.

BRIEF SUMMARY

The present invention relates to a liner for a shaped Charge 100 for penetrating hard targets, wherein the liner comprises i) a carrier 110 having a density below 9500 kg/m$^3$; and ii) a coating 120 deposited on said carrier comprising at least one metal and/or metal oxide, wherein the coating has a density greater than 10000 kg/m$^3$;

wherein the thickness ratio of the carrier 110 i) to the coating 120 ii) ranges from 100:1 to 1:1, and wherein the oxygen content in the coating ii) is less than 100 ppm atomic.

According to one embodiment, the density of the carrier i) is lower than 9000 kg/m$^3$.

According to one embodiment, the coating ii) has a density greater than 15000 kg/m$^3$, preferably greater than 18500 kg/m$^3$.

According to one embodiment, the carrier i) is a metal, metal oxide, plastics, ceramics or a mixture thereof, preferably the carrier consists of copper. According to one embodiment, the coating ii) is selected from tungsten, molybdenum, silver, tantalum, lead, platina, or mixtures thereof, preferably the coating ii) consists of tungsten.

By the term "hard target" is meant any target having a hardness higher than about 100 HB, for example higher than about 300 HB or higher than 500 HB. According to one embodiment, the hardness of the hard target is in the range from 100 to 1500, preferably from 200 to 1000 such as from 300 to 800 HB.

According to one embodiment, the carrier i) has a thickness ranging from 0.5 to 5, preferably from 1 to 3, and most preferably from 1 to 2 mm.

According to one embodiment, the coating ii) has a thickness ranging from 0.05 to 0.5, preferably from 0.05 to 0.3, more preferably from 0.05 to 0.2, and most preferably from 0.1 to 0.2 mm. The coating ii) is deposited on the carrier i) such that it entirely covers carrier i).

According to one embodiment, the porosity of the coating ranges from about 0 to 3%, preferably from 0 to 1.5%, even more preferably from 0.001 to 0.5%, and most preferably from about 0 to 0.3%.

The term porosity as used herein is a measure of the void (i.e. "empty") spaces in a material, and is a fraction of the volume of voids over the total volume as a percentage between 0 and 100%.

The porosity is thus defined by the ratio:

$$\phi = V_V / V_T$$

where $V_V$ is the volume of void-space (such as fluids) and $V_T$ is the total or bulk volume of material, including the solid and void components. The porosity is determined as set out in the article *Porosity Measurements and Analysis for Metal Additive Manufacturing Process Control*, Journal of Research of the National Institute of Standards and Technology, Slotwinski et al., Volume 119 (pp. 494-528), 2014.

According to one embodiment, the weight ratio of the coating to the carrier ranges from 1:5 to 1:1, most preferably from 1:4 to 1:3.

According to one embodiment, the average particle size of the coating ii) ranges from 0.1 to 100, more preferably from 1 to 50, and most preferably from 10 to 25 nm. It has been found that an average particle size as defined herein results in low porosity or a non-porous coating ii) and thus low oxygen content which in turn results in reduced brittleness.

According to one embodiment, at least one intermediate layer, e.g. aluminium, molybdenum, silver, tantalum, lead, platina, or mixtures thereof, preferably aluminium, is deposited on the carrier prior to deposition of coating ii). In such embodiment, the coating ii) will be deposited partially or entirely on said at least one intermediate layer. Preferably, the thickness of said at least one intermediate layer ranges from 0.05 to 2, most preferably from 0.05 to 1 mm. Preferably, the density of said at least one intermediate layer ranges from 2500 to 21000, most preferably from 2500 to 3000 kg/m$^3$.

It has been found that an intermediate layer, in particular an aluminium-based intermediate layer, showing different properties than the coating ii) may contribute to an increase in pressure inside the penetrated target, e.g. on the side opposite to the point of impact of a projectile in a hard target such as armour, e.g. a vehicle or wall armour. According to one embodiment, at least two intermediate layers are deposited on the carrier i). Preferably a second intermediate layer is deposited on the first intermediate layer. Preferably, the thickness of the intermediate layers is within the thickness ranges of the coating ii). On top of the uppermost intermediate layer, the coating ii) is deposited.

According to the present invention, it has been found only a portion of the liner forms a penetrating jet subsequent to detonation of the contained explosive, whereas the remaining portion, typically the carrier, forms a slug which does not contribute to further penetration. The present invention thus offers an optimized balance between long range of the projectile comprising the liner due to the low-density carrier whereas the high-density coating forming the penetrating jet is as thin as possible to offer sufficient penetration in the target. The lower weight of the liner thus renders the projectile in which the liner is used lighter.

According to one embodiment, the liner is formed as a cone, frusto-cone, funnel, tulip, arc or trumpet, preferably a cone. Preferably, the shaped-charge projectile has an external appearance similar to a conventional projectile or round but the internal structure is different. Behind the front end of the hollow-shell container is a metallic shaped charge liner.

Positioned further behind the metallic shaped-charge liner is an explosive charge. A detonator is preferably in contact with the explosive charge.

According to one embodiment, the shaped charge has a hollow, preferably substantially cylindrical container or casing in which an explosive charge is located. Preferably, the casing is constructed of a material of sufficient strength to act as a retainer for the explosive material. As an example, the casing may be a dense material such as lead, die cast aluminium, zinc alloys or steel. Preferably, the charge is formed with a hollowed out end or cavity. The charge may be any conventional explosive charge. Any suitable means known in the art may be used to detonate the explosive charge.

According to one embodiment, the ammunition unit in which the shaped charge is implemented is a projectile, a shell, or a robot.

Preferably, the oxygen content in the coating is less than less than 30 ppm atomic, and most preferably less than 15 ppm atomic such as less than 5 ppm atomic. By ppm atomic oxygen is meant quotient of oxygen atoms to (oxygen atoms and remaining coating material) which also corresponds to the mole fraction of oxygen relative to the total amount of mole in the coating including oxygen and remaining coating material. Preferably, an electron microscope is employed when determining the oxygen content.

Preferably, the ductility of the carrier is high to provide for flexible formation thereof.

Preferably, the melting point of the coating material ranges from 2000 to 4000, most preferably from 3000 to 3700° C.

According to one embodiment, the explosive contained in the housing of the shaped charge may be e.g. HMX, TNT, HNS, RDX, HNIW, or TNAZ.

The invention also relates to a shaped charge liner obtainable by the method as defined herein. The invention also relates to the use of a shaped charge liner in a projectile for penetrating a hard military target.

The invention also relates to a method of providing a liner for shaped charge as defined herein.

Preferably, the coating ii) is deposited on the carrier i) by means of gas condensation, sputtering deposition or electrodeposition techniques, more preferably by means of chemical vapour deposition (CVD) or physical vapour deposition, and most preferably by means of chemical vapour deposition (CVD).

As an example, CVD for tungsten may be achieved from tungsten hexafluoride ($WF_6$), which may be deposited in two ways:

$$WF_6 \rightarrow W + 3F_2$$

$$WF_6 + 3H_2 \rightarrow W + 6HF$$

Other metals such as aluminium, molybdenum, tantalum may likewise be deposited by means of CVD.

According to one embodiment, the carrier i) is prepared by 3D printing, also known as additive manufacturing (AM) wherein layers of material are formed under computer control to create an object. The carrier i) may also be provided by other conventional methods, e.g. metal working or punching.

According to one embodiment, tungsten is deposited on copper, preferably by means of chemical vapour deposition.

According to one embodiment of the chemical vapour deposition method, the material to be coated is placed inside a vacuum chamber dictating the maximum size of objects that can be coated. Then, the coating material is heated, or the pressure around it is reduced until the material vaporizes, either inside the vacuum chamber or in an adjacent area from which the vapour can be introduced. There, the suspended material begins to settle onto the substrate material (carrier) and form a uniform coating. Adjusting the temperature and duration of the process makes it possible to control the thickness of the coating. Metals or metal compounds heated to metal vapour deposits on a cooler carrier. It goes without saying the entire carrier i) is coated by the coating ii), i.e. along the whole extension of the carrier i).

The invention being thus described, it will be obvious that the same may be varied in many ways. Such variations are not to be regarded as a departure from the spirit and scope of the invention, and all such modifications are intended to be included within the scope of the following claims.

The invention claimed is:

1. A liner for shaped charge for penetrating hard targets, the liner comprising:

a carrier having a density below 9500 kg/m$^3$; and a coating deposited on said carrier so as to form a penetrating portion of a forming jet of the shaped charge, whereby the penetrating portion consists of the material of the coating, wherein:

the coating comprises at least one metal;

the coating has a density greater than 10000 kg/m$^3$;

the thickness ratio of the carrier to the coating ranges from 100:1 to 1:1; the oxygen content in the coating is less than 100 ppm;

the metal of the coating is selected from tungsten, lead, molybdenum, silver, tantalum, platina, or mixtures thereof; and the average particle size of the coating ranges from 0.1 to 100 nm.

2. Liner according to claim 1, wherein the density of the carrier is lower than 9000 kg/m$^3$.

3. Liner according to claim 1, wherein the coating has a density greater than 15000 kg/m$^3$.

4. Liner according to claim 1, wherein the coating has a density greater than 18500 kg/m$^3$.

5. Liner according to claim 1, wherein the carrier is a metal, metal oxide, plastics, ceramics, or a mixture thereof.

6. Liner according to claim 1, wherein the carrier has a thickness ranging from 0.5 to 5 mm.

7. Liner according to claim 1, wherein the coating has a thickness ranging from 0.05 to 0.5 mm.

8. Liner according to claim 1, wherein the carrier consists of copper.

9. Liner according to claim 1, wherein the coating consists of tungsten.

10. Liner according to claim 1, wherein the porosity of the coating ranges from about 0 to 3%.

11. Liner according to claim 1, wherein the weight ratio of the coating to the carrier ranges from 1:5 to 1:1.

12. Method of producing a shaped charge liner according to claim 1, wherein the coating is deposited on the carrier.

13. Method according to claim 12, wherein the coating is deposited by means of gas condensation, sputtering deposition or electrodeposition techniques.

14. Method according to claim 12, wherein the coating is deposited by means of chemical vapour deposition.

15. Method according to claim 12, wherein tungsten is deposited on copper.

16. Method according to claim 12, wherein tungsten is deposited on copper by means of chemical vapour deposition.

17. Method according to claim 12, wherein an intermediate layer is formed on the carrier prior to deposition of said coating.

18. Use of a shaped charge liner according to claim 1 in a projectile for penetrating a hard military target.

19. Liner according to claim 1, wherein the average particle size of the coating ranges from 50 to 100 nm.

20. A liner for shaped charge for penetrating hard targets, the liner comprising:

a carrier having a density below 9500 kg/m$^3$; and a coating deposited on said carrier so as to form a penetrating portion of a forming jet of the shaped charge, whereby the penetrating portion consists of the material of the coating, wherein:

the coating comprises at least one metal;

the coating has a density greater than 10000 kg/m$^3$;

the thickness ratio of the carrier to the coating ranges from 100:1 to 1:1; the oxygen content in the coating is less than 100 ppm;

the metal of the coating is selected from tungsten, lead, molybdenum, silver, tantalum, platina, or mixtures thereof; and the porosity of the coating ranges from about 0.0001 to 1.5%.

21. Liner according to claim 20, wherein the porosity of the coating is selected from one of the following ranges: about 0.0001 to 0.5% and about 0.0001 to 0.3%.

* * * * *